US006802107B2

(12) United States Patent
Pan

(10) Patent No.: US 6,802,107 B2
(45) Date of Patent: Oct. 12, 2004

(54) SELF-LOCKING HINGE APPARATUS WITH A SINGLE STABLE STATE

(75) Inventor: Long-Jyh Pan, Hsi Chih (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 10/342,099

(22) Filed: Jan. 15, 2003

(65) Prior Publication Data

US 2003/0150083 A1 Aug. 14, 2003

(30) Foreign Application Priority Data

Feb. 8, 2002 (TW) ..... 91201797 U

(51) Int. Cl.[7] ..... E05D 11/10

(52) U.S. Cl. ..... 16/325; 16/284; 16/285; 16/303

(58) Field of Search ..... 16/277, 284, 285, 16/297, 303, 319, 325, 328, 332

(56) References Cited

U.S. PATENT DOCUMENTS 4,761,976 A * 8/1988 Kleinhany ..... 70/277
5,600,868 A * 2/1997 Tourville et al. ..... 16/277
6,634,061 B1 * 10/2003 Maynard ..... 16/342

* cited by examiner

*Primary Examiner*—Robert E. Pezzuto
*Assistant Examiner*—Tara L. Mayo
(74) *Attorney, Agent, or Firm*—Troxell Law Office PLLC

(57) ABSTRACT

A self-locking hinge apparatus with a single stable state includes a pivotal shaft, a retaining ring, a stator, a compression spring, and a rotor. The retaining ring, the compression spring, the stator and the rotor are arranged in series along the pivotal shaft. The stator is slide-able but not rotatable on the pivotal shaft. The rotor is both slide-able and rotatable on the pivotal shaft. By providing the compression spring to enforce a cam-contact between the stator and the rotor, an auto cam sliding pair is then formed to make the hinge apparatus stabilized automatically at the predetermined stable state.

19 Claims, 5 Drawing Sheets

SELF-LOCKING HINGE APPARATUS WITH A SINGLE STABLE STATE

BACKGROUND OF THE INVENTION (1) Field of the Invention

The present invention relates to a self-locking hinge apparatus with a single stable state, and more particularly to a hinge apparatus that employs a cam-pattern-like sliding contact between two matching elements for automatically achieving a single stable state.

(2) Description of the Prior Art

A conventional hinge apparatus is general a folding mechanism deployed between two sets of boards, or between one object and another object. The most common used one of those is a free hinge for pivoting a door. Such a type of hinges, usually waiving anchoring components, allows the door to swing freely. In another aspect, such a type of hinge apparatus does not have a local high point in the potential energy diagram, or say a local point of minimum potential energy. While those hinges are applied to fold two boards or objects, no control ability can be provided during the hinging operation.

There are other types of hinge apparatus adopted to be used on swing doors that are constantly closed in normal conditions. Such a type of hinge apparatus generally includes a special pivotal shaft to serve as a common axis and a returning mechanism to provide both a damping force and a return force to close the door. The returning mechanism has one end fastened to the door and another end fastened to the wall at where the door is mounted. When the door is swiveled and opened by an external force, potential energy is stored in the returning mechanism. When the external force is relieved, the returning mechanism releases the potential energy to allow the door to close slowly (due to the function of the damper). However, such types of hinge apparatus tend to gradually get loose and cannot close the door effectively when the dampers are aged. In other words, the minimum-potential energy points of such types of hinge apparatus tends to shift and deviate because of aging of elements.

Viewing previous two types of hinge apparatus set forth above, one does not have a local stable position (such as free hinges), and another has a single local potential energy low point (such as swing doors that are constantly closed). In still another types of hinge apparatus, there are two local minimum-potential energy points, such as hinge apparatus adapted for use on some cabinets or protection covers for button keys of cell phone handsets. They have a torsion spring and a retain structure mounted to selected locations between boards to form two local stable points (i.e. two relative minimum-potential energy points). These two local stable points are generally arranged on a closed and an open location of the targeted object. Take the openable protection cover for button keys of a handset as an example, the hinge apparatus for connecting the cover plate and the handset body usually has two local stable points. One is the closed position of the cover plate over the button keys. Another one is the open position with the cover plate pivotally turned to a selected angle for users to dial phone numbers or to hear the phone. By the same token, the hinge apparatus commonly used for opening doors of cabinets, depending on locations of the cabinet doors, also have a cabinet door open position and a cabinet door closed position.

As discussed previously, an improved hinge apparatus has two local stable points. It can provide control function, and thus has great benefits in applications. Take the cover plate of a handset for example, upon when to open or close the cover plate, users may hold the handset with one hand, and push or lift the cover plate for a selected distance to provide a sufficient external force for making the hinge apparatus to jump from one local stable point to another local stable point, and thereby to change the condition of the cover plate. However, in such type of applications, a torque should be provided to change the condition. In terms of human hand operation characteristics, folding operation of two-board elements, especially for smaller-size devices such as handsets, requires both hands to complete, with one hand to hold the handset and another to exert a torque upon the cover plate. The operation is obviously not convenient, and thus any improvement shall be welcome.

SUMMARY OF THE INVENTION

Accordingly, it is a primary object of the present invention to provide a self-locking hinge apparatus that employs cam sliding contact between two co-axial elements to produce a single stable state (or say, equilibrium state) such that it can be stabilized automatically at the predetermined stable state wherever it is initially posed.

The self-locking hinge apparatus with a single stable state according to the invention enables a hinge to turn and stabilize automatically at the single stable state. The hinge apparatus consists of a pivotal shaft, a retaining ring, a stator, a compression spring and a rotor. The retaining ring, the compression spring, the stator and the rotor are arranged in series along the pivotal shaft.

In the present invention, the pivotal shaft of the present invention has a retaining end and a free end. The retaining ring is slidably mounted on the pivotal shaft at the retaining end. The stator is mounted on the pivotal shaft in a slide-able but not rotational manner. The compression spring is mounted on the pivotal shaft between the retaining ring and the stator. The rotor is slidably mounted on the pivotal shaft proximate to the free end, and contacts the stator.

According to one embodiment of the invention, the rotor has a sliding surface facing the stator. The sliding surface is a strictly concave surface (i.e. with a smooth contour allowing an object sliding thereon freely without restriction) surrounding the pivotal shaft. The sliding surface has a lowest point. The stator has a bulged point extending to and pressing onto the sliding surface. When the contact point between the stator and the rotor is initiated at any local point, the compression spring can depress the bulged point of the stator against the sliding surface of the rotor in the axial direction of the pivotal shaft, and the rotor is driven to turn about the pivotal shaft until the bulged point reaching the lowest point of the sliding surface. In other words, the rotation of the rotor stops only when the hinge apparatus has reached the stable state.

In this embodiment, the bulged point of the stator is the most protrusive point of a convex surface.

In order to make the stator sliding along the pivotal shaft without rotating, in one embodiment of the invention, the cross section of the pivotal shaft that holds the stator has at least one chamfered surface, and the stator has a shaft opening complementing the chamfered cross section of the pivotal shaft.

In one embodiment of the invention, the pivotal shaft that holds the stator is a round axle having at least one axial key way, and the shaft opening of the stator has a jutting key matching and engageable with the key way to allow the stator to slide on the pivotal shaft without rotating.

In another embodiment of the invention, the stator has a stator surface facing the rotor. The stator surface is a strictly concave surface surrounding the pivotal shaft. The stator surface has a lowest point. The rotor has a bulged point extending to and pressing onto the stator surface. When the stator and the rotor is initiated at any local point, the compression spring depresses the stator surface of the stator against bulged point of the rotor in the axial direction of the pivotal shaft, and the rotor is driven to turn about the pivotal shaft until the bulged point reaching the lowest point of the stator surface.

In this embodiment, the bulged point of the rotor is the most protrusive point of a convex surface.

The self-locking hinge apparatus with a single stable state according to the invention may be used in the folding apparatus discussed in the background of the invention. The folding apparatus may consist of a first member, a second member and at least one self-locking hinge apparatus located between the first member and the second member. By providing the invention, there is a single stable state between the first member and the second member, and the first member and the second member may be freely folded relative to each other and still reaches the designed stable state.

According to the invention, the pivotal shaft and a respective pivotal shaft's retention can be connected to a first installation side of the first member, and an outer rim of the rotor and an outer rim of the retaining ring can be connected to a second installation side of the second member. In other words, the hinge apparatus is located between the first installation side and the second installation side to allow the first member and the second member to move and fold over each other.

The folding apparatus according to the invention may also include a latch structure to manipulate another stable state other than aforesaid one, and thus to form an anchoring relationship between the first member and the second member. The anchoring relationship is usually a folding state. The latch structure may include a first latch element on the first member and a corresponding second latch element on the second member. When the first latch element and the second latch element are engaged, the first member is overlapping upon the second member.

In one embodiment of the folding apparatus of the invention, the first latch element of the latch structure is located on the first member, and the second latch element is located on the second member at a location corresponding to the first latch element. The first latch element and the second latch element may not connect with the hinge apparatus. Therefore, the latch structure may be simplified to reduce the complexity of the folding apparatus.

In an embodiment of the folding apparatus of the invention, the latch structure may be simultaneously made with the self-locking hinge apparatus. The implementation can include: a) forming a retaining section on the first member that is extended to the free end of the pivotal shaft as an outer retention of the rotor; b) forming a retaining bulged point located on the rotor facing one side of the free end of the pivotal shaft as the second latch element of the latch structure; c) forming a retaining trough located on the retaining section corresponding to the retaining bulged point as the first latch element; d) further including a compression member located on the retaining section to the latch structure; e) when the retaining bulged point and the retaining trough forming a latched condition, the first member and the second member forming a stacking condition or other folding conditions; and f) when the compression member subjected to a force for releasing the latch condition between the retaining bulged point and the retaining trough, the rotor rotating due to auto cam sliding pair function formed by the stator surface and the sliding surface until the sliding stops, i.e. reaching the stable state of the self-locking hinge apparatus.

In an embodiment of the folding apparatus of the invention, the retaining section may have a second retaining ring to contact the rotor, and the latch structure may include a retaining trough of the first latch element formed on the second retaining ring facing one side of the rotor. The operation of "the compression member subjects to a force" previously discussed is "to move the rotor to separate the retaining bulged point from the retaining trough". In this embodiment, in order to increase wearing durability of relative sliding between the second retaining ring and the rotor, the second retaining ring is preferably made of metal such as brass or the like.

The foregoing, as well as additional objects, features and advantages of the invention will be more readily apparent from the following detailed description, which proceeds with reference to the accompanying drawings.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a self-locking hinge apparatus with a single stable state. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

In the following discussions, in order to maintain consistency of the description, elements with the same or similar function will be marked by the same numerals.

Figure 1:
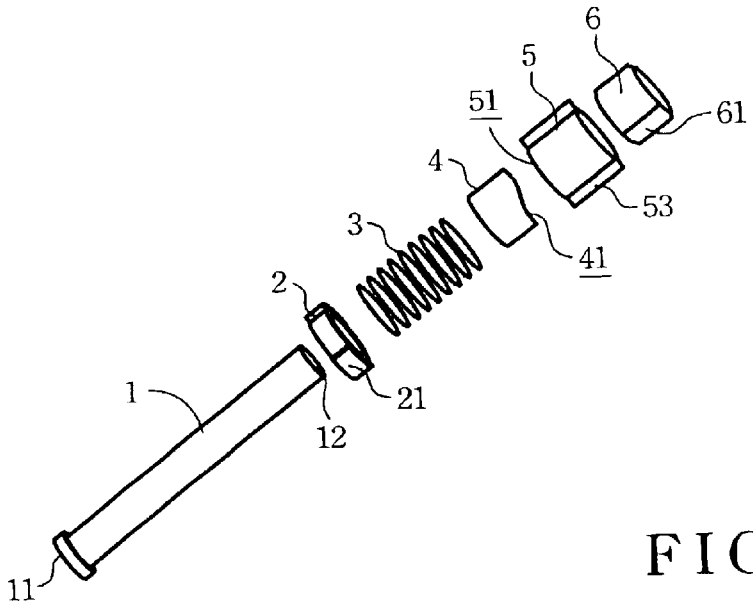
FIG. 1 is an exploded view of a first embodiment of the self-locking hinge apparatus with a single stable state of the invention.

Refer to FIG. 1 for an embodiment of a self-locking hinge apparatus with a single stable state according to the invention. As shown in the drawing, the self-locking hinge apparatus of the invention aims to provide hinge rotation movements and to enable the hinge apparatus to automatically stabilize at a single stable state. The hinge apparatus consists of a pivotal shaft 1, a retaining ring 2, a stator 4, a compression spring 3, a rotor 5 and a shaft retainer 6. The retaining ring 2, the compression spring 3, the stator 4, the rotor 5 and the shaft retainer 6 are mounted in series on the pivotal shaft 1.

The pivotal shaft 1 provides a rotation and moving channel for all other elements, and has, in the axial direction, a retaining end 11 located at one end and a free end 12 located at another end thereof.

The retaining ring 2 is pivotally and slidably mounted on the pivotal shaft 1 at the retaining end 11 to serve as a holding seat for the compression spring 3 to rest thereon, and has a retaining outer rim 21 to serve as an interface to connect a hinged object.

The stator 4 is mounted on the pivotal shaft 1 in a "slide-able but not rotatable" manner, and has one end pressing against the compression spring 3 and another end forming a stator surface 41.

The compression spring 3 is mounted on the pivotal shaft 1 between the retaining ring 2 and the stator 4 for storing and providing elastic potential energy required in the operation of the self-locking hinge apparatus of the invention.

The rotor 5 is slidably and pivotally mounted on the pivotal shaft 1 adjacent to the free end 12, and has a sliding surface 51 facing the stator surface 41 to contact the stator 4 and a rotation outer rim 53 to serve as an interface to connect the hinged object.

The shaft retainer 6 is a rotation retention located on the free end 12 of the pivotal shaft 1 to keep all other elements assembled and mounted on the pivotal shaft 1, and has a retaining outer rim 61 to serve as another coupling interface to connect an external object. In other embodiments (not shown in the drawing), the shaft retainer 6 may be a conventional shaft retaining element such as a C-shaped clip washer, or be directly formed on the matching apparatus. That is, the shaft retainer 6 is not a mandatory element in terms of the structure of the self-locking hinge apparatus of the invention.

The main characteristics of the invention is to employ the inter-relationship among the compression spring 3, the stator 4 and the rotor 5 to form a positive compression contact between the stator surface 41 and the sliding surface 51 so as to form an auto cam sliding pair, and through the design of the cam to form a matching contour for reaching a single stable state.

Figure 2A:
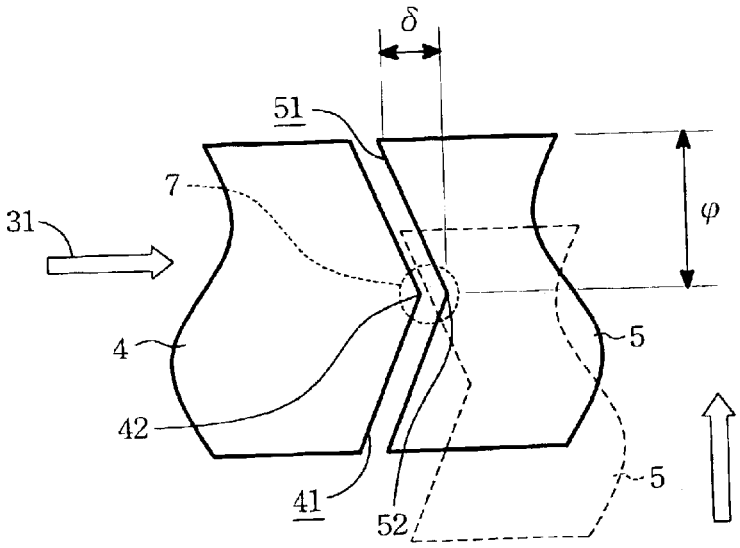
FIG. 2A is a schematic extending view of an embodiment of an auto cam sliding pair of the invention.

Refer to FIG. 2A for the contour extension of an embodiment of the auto cam sliding pair according to the invention. The stator surface 41 of the stator 4 is a convex surface with a bulged point 42. The sliding surface 51 of the rotor 5 is a concave surface corresponding to the stator surface 41 and has a lowest point 52. Through a compression force 31 applying on the stator 4 by the compression spring 3, a component force of the compression force 31 is generated on the contact point or surface between the stator surface 41 and the sliding surface 51 when the rotor 5 is initiated at any matching position (such as the position of the rotor 5 shown by the broken lines in the drawing), and then automatic sliding occurs until the lowest potential energy position where is the sliding stop point 7 is reached. And this is the single stable state of the auto cam sliding pair of the invention. The solid lines as shown indicate the relative position. It is noted that, in FIG. 2A, the gap between the stator surface 41 and the sliding surface 51 is only faked for illustration purpose. Actually in practice, the stator surface 41 and the sliding surface 51 contact each other. At the sliding stop point 7, the bulged point 42 of the stator surface 41 and the lowest point 52 of the sliding surface 51 are matched.

Figure 3A:
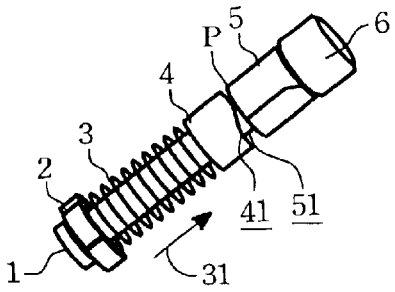
FIG. 3A is a perspective view of an embodiment of the invention, at one position.
Figure 3B:
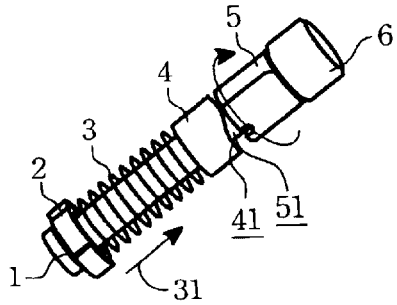
FIG. 3B is a perspective view according to FIG. 3A, after the rotor having auto self-rotated for an angle.
Figure 3C:
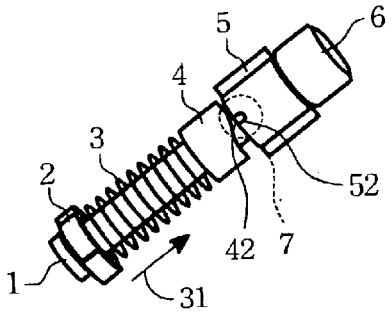
FIG. 3C is a perspective view according to FIG. 3B, after the rotor has auto self-rotated to a stable state.

Refer to FIGS. 3A through 3C for operating conditions of the embodiment shown in FIG. 1. As previously discussed, when the stator surface 41 of the stator 4 and the sliding surface 51 of the rotor 5 contact against each other at a point P (as shown in FIG. 3A), the compression force 31 of the compression spring 3 pushes the sliding surface 51 of the rotor 5 automatically to slide on the stator surface 41 of the stator 4, and in the mean time, the rotor 5 is driven to rotate relative to the stator 4 (as shown in FIG. 3B). Due to the compression force 31, the rotor 5 rotates continuously in an auto cam sliding fashion until the sliding stop point 7 is reached (i.e. the bulged point 42 of the stator surface 41 arriving the lowest point 52 of the sliding surface 51, as shown in FIG. 3C).

In the invention, the feeding displacement $\delta$ of the auto cam sliding formed by the stator 4 and the rotor 5, the corresponding position of the sliding stop point 7 on the sliding contour (i.e. the corresponding distance of $\phi$), and the matching between the stator surface 41 and the sliding surface 51 are adopted non-interference design (as shown in FIG. 2A). And the design may vary according to possible application requirements. Such design variations are well-known in the art of cam designs, thus are omitted herein.

The design of the auto cam sliding pair for the embodiment shown in FIG. 2A may be made as follows. The stator surface 41 serves as a matching convex surface, and the sliding surface 51 performs the matching concave surface. The characteristics of this embodiment is that the rotor 5 has a sliding surface 51 facing the stator 4 while the sliding surface 51 is a strictly concave surface surrounding the pivotal shaft 1. That is, except for the lowest point 52, the concave surface is shaped in a contour with no obstacle formed or located thereon to stop the sliding of an object. The sliding surface 51 has a lowest point 52, while the stator 4 has a bulged point 42 extending to and pressing on the sliding surface 51. When contact of the stator 4 and the rotor 5 initiates at any position, the compression spring 3 can push the bulged point 42 of the stator 4 in the axial direction of the pivotal shaft 1 on the sliding surface 51 of the rotor 5. Thereby, the sliding surface 51 automatically slides on the bulged point 42, and the rotor 5 is driven to rotate about the pivotal shaft 1 until the bulged point 42 reaches the lowest point 52 of the sliding surface 51. In other words, the rotation of the rotor 5 stops until it reaches the stable state 7 of the hinge apparatus.

Figure 2B:
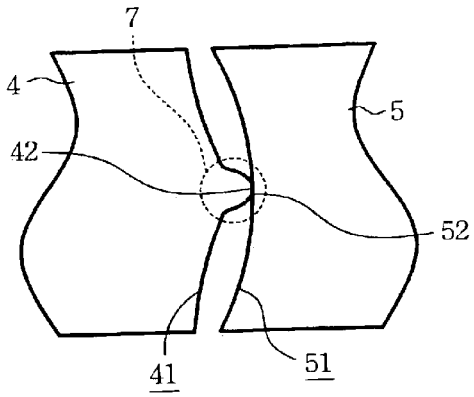
FIG. 2B is a schematic extending view of another embodiment of an auto cam sliding pair of the invention.
Figure 2C:
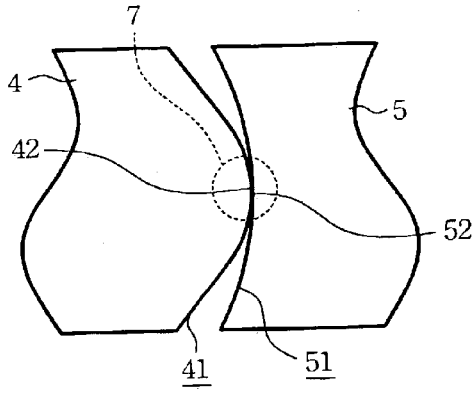
FIG. 2C is a schematic extending view of a further embodiment of an auto cam sliding pair of the invention.

In the embodiment of the auto cam sliding pair of the invention, the bulged point 42 of the stator 4 is the highest extending point of a convex surface that may be formed by two wedge surfaces as shown in FIG. 2A, or a conspicuous jutting head as shown in FIG. 2B, or a strictly convex surface formed naturally as shown in FIG. 2C.

Figure 2D:
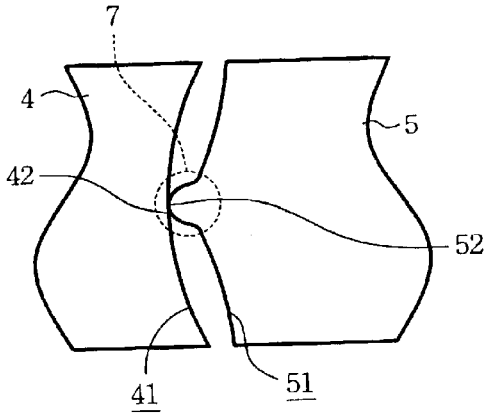
FIG. 2D is a schematic extending view of yet another embodiment of an auto cam sliding pair of the invention.
Figure 2E:
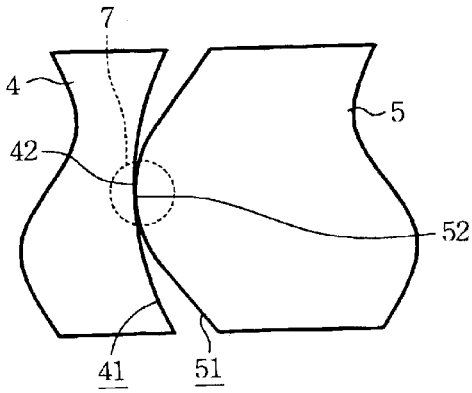
FIG. 2E is a schematic extending view of still another embodiment of an auto cam sliding pair of the invention.

In the embodiment of the auto cam sliding pair set forth above, the stator surface 41 and the sliding surface 51 are respectively formed by a convex surface and a concave surface. Of course, the design may also be altered and replaced by a concave surface and a convex surface (as shown in FIGS. 2D and 2E). In such a circumstance, the stator 4 has the stator surface 41 formed in a strictly concave surface surrounding the pivotal shaft 1 and faced the rotor 5, and had a lowest point 42. The rotor 5 has a bulged point 52 extended to and pressed on the stator surface 41. When the stator 4 and the rotor 5 are initiated at any local point, the compression spring 3 pushes the stator surface 41 of the stator 4 in the axial direction of the pivotal shaft 1 on the bulged point 52 of the rotor 5. Thereby, the bulged point 52 automatically slides on the stator surface 41, and the rotor 5 is driven to rotate about the pivotal shaft 1 until the bulged point 52 reaches the lowest point 42 of the stator surface 41 (i.e. until reaching the stable state 7).

Figure 4A:
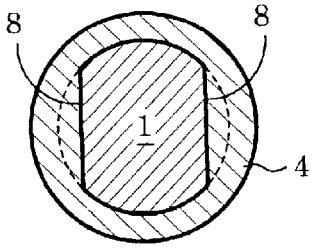
FIG. 4A is a cross section of an embodiment of the invention, showing a pivotal shaft coupling with a stator.
Figure 4B:
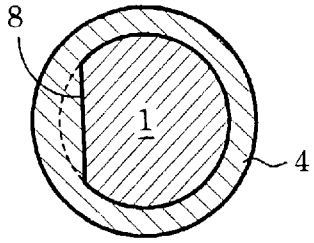
FIG. 4B is a cross section of another embodiment of the invention, showing a pivotal shaft coupling with a stator.
Figure 4C:
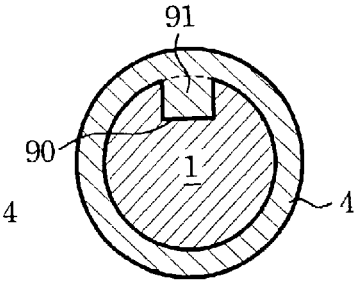
FIG. 4C is a cross section of yet another embodiment of the invention, showing a pivotal shaft coupling with a stator.

In the invention, there are various prior arts such as straddle rails or the like may be adopted to enable the stator to achieve movements of "slide-able but not rotatable" on the pivotal shaft. For instance, in FIGS. 4A and 4B, the cross section of the pivotal shaft 1 corresponding to where the stator 4 is located has a chamfered section 8 (two chamfered sections 8 are formed in FIG. 4A, and a single chamfered section 8 is formed in FIG. 4B). Accordingly, the stator 4 has a shaft opening with a complementary cross section corresponding to the chamfered section. FIG. 4C illustrates another embodiment in which the pivotal shaft 1 has at least one axial key way 90 formed on a location corresponding to where the stator 4 is located, and the shaft opening of the stator 4 has a jutting key 91 corresponding to and coupling with the key way 90, so that the stator 4 is able to perform "slide-able but not rotatable" movements on the pivotal shaft 1.

Figure 5A:
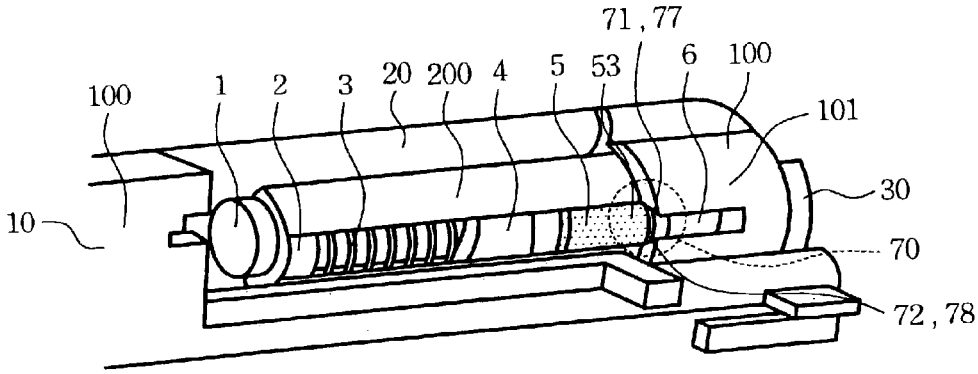
FIG. 5A is a perspective view of an embodiment of a folding apparatus, with the latch structure at a latched position.

Refer to FIG. 5A for the self-locking hinge apparatus of the invention adopted for use in a folding apparatus mentioned previously in the background of the invention (taking a handset as an example). The folding apparatus may include a first member 10, a second member 20 and at least one self-locking hinge apparatus of the invention. As shown in FIG. 5A (also referring to FIG. 1), the hinge apparatus has the retaining end 11 of the pivotal shaft 1 and the shaft retainer 6 mounting to a first installation side 100 of the first member 10, and has the retaining outer rim 21 of the retaining ring 2 and the rotation outer rim 53 of the rotor 5 forming a retaining connection with a second installation side 200 of the second member 20. Thereby, the first member 10 and the second member 20 may utilize the hinge apparatus of the invention to establish a folding and a single stable state operation relationship.

As shown in FIG. 5A, the folding apparatus of the invention may further include a latch structure 70 which, in addition to stabilize the hinge apparatus, also enables the first member 10 and the second member 20 to form an anchoring relationship with each other (as the positioning condition shown in FIG. 5A). The anchoring relationship in general is a folding condition. The latch structure 70 may include a first latch element 71 located on the first member 10 and a second latch element 72 located on the second member 20. When the first latch element 71 and the second latch element 72 are coupled, the first member 10 is stacked on one side of the second member 20. The latch structure 70 shown in FIG. 5A is made simultaneously with the self-locking apparatus. They can be constructed as follows: the first member 10 includes a retaining section 101 extending to the free end 12 of the pivotal shaft 1 to form an outer retention of the rotor 5; the second latch element 72 of the latch structure 70 is a retaining bulged point 78 (may be formed by extending the rotation outer rim 53) located on the rotor 5 facing one side of the free end 12 of the pivotal shaft 1; and the retaining section 101 of the first latch element 71 is a retaining trough 77 corresponding to the retaining bulged point 78. As shown in the drawing, the latch structure 70 may further include a compression member 30 located on the retaining section 101 for controlling latching operation of the latch structure 70.

When the retaining bulged point 78 of the rotor 5 (i.e. the second latch element) and the retaining trough 77 (i.e. the first latch element) of the retaining section 101 form a latched retention (as shown in FIG. 5A), the first member 10 and the second member 20 can form a stacking (overlapping) condition or other folding conditions at an angle. That is to say that, through an external force and the retention relationship provided by the latch structure 70, the hinge apparatus can be anchored on an unstable state and achieve the self-locking function described above. When the compression member 30 is depressed for relieving the latch retention between the retaining bulged point 78 and the retaining trough 77 (as shown in FIG. 5B), the rotor 5 rotates according to the auto cam sliding pair function of the stator surface 41 and the sliding surface 51 (the second member 20 is also driven and rotates relative to the first member 10) until the sliding between the stator surface 41 and the sliding surface 51 stops (refer to FIGS. 3A through 3C for detailed operations), i.e. until the self-locking hinge apparatus reaches its stable state.

Figure 5B:
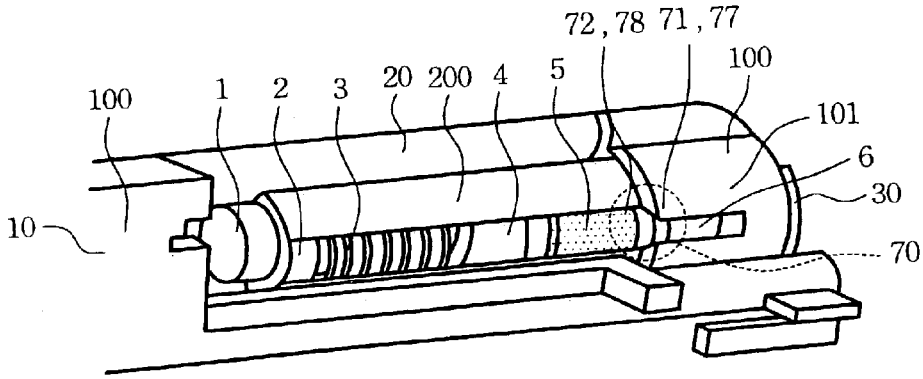
FIG. 5B is a perspective view according to FIG. 5A, with the latch structure at a latch-released position, and the rotor is at a rotation start position.

In FIGS. 5A and 5B, the compression member 30 is a pushbutton type element. It is operated and controlled by moving the shaft retainer 6 for driving the retaining bulged point 78 of the rotor 5 to separate from the retaining trough 77 of the retaining section 101. When the retaining bulged point 78 is separated from the retention boundary of the retaining trough 77, the rotor 5 generates the rotation shown in FIGS. 3A through 3C which results from reactions of the stator 4 and the compression spring 3. In the embodiment of the handset, the advantages from employing the hinge apparatus of the invention are obvious. For example, while using the handset (for dialing or receiving), users may depress the compression member 30 single-handed to open the cover plate (second member 20) and make the cover plate automatically bouncing away from the handset body (first member 10) through the automatic stabilizing operation of the hinge apparatus. Thus, the cover plate may be opened rapidly and the problem of using two hands to open the cover plate that incurs to the conventional structure described in aforesaid background section may be overcome.

In the invention, the latch structure 70 may adopt any well-known techniques in the art without limited to the embodiment example shown in FIG. 5A.

Figure 6:
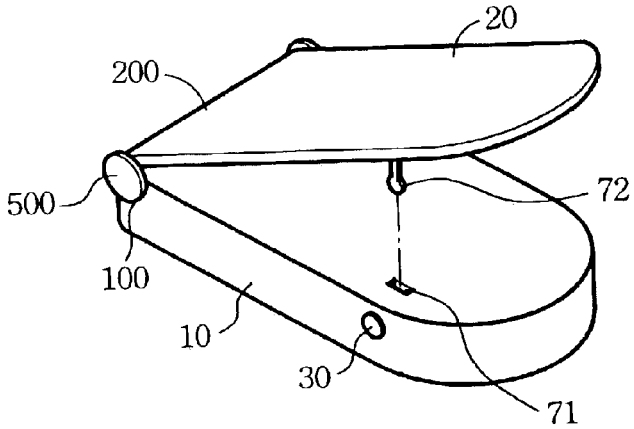
FIG. 6 is a schematic view of an embodiment of a latch structure of the invention.

FIG. 6 shows another folding apparatus (also taking the handset as an example). The first latch element 71 of the latch structure is located on a first member 10 remote to the hinge apparatus 500 of the invention. The second latch element 72 is located on a second member 20 at a location corresponding to the first latch element 71. The compression member 30 may be located on a lateral side of the first member 10 proximate to the first latch element 71. As shown, the first latch element 71 and the second latch element 72 do not connect with the self-locking hinge apparatus 500, and also do not located on the first installation side 100 or the second installation side 200. However, the object of opening the cover plate 20 single-handed can be still accomplished. Such a construction can also simplify the latch structure installed on the folding apparatus.

In the embodiment shown in FIG. 5A, the shaft retainer 6 serves as the connection element of another end of the hinge apparatus and the first member 10. However, as previously discussed, the shaft retainer 6 is not a mandatory element of the hinge apparatus of the invention. In the embodiment shown in FIG. 5A, the shaft retainer 6 may be dispensed. Instead, the retaining section 101 may be directly formed on one end of the pivotal shaft 1 to serve this purpose. The operation of moving the compression member 30 can be done by directly moving the rotor 5. Of course, construction among the compression member 30, the pivotal shaft 1, the rotor 5 and the retaining section 101 must be adjusted accordingly. Required adjustments are known by those skilled in the art, thus are omitted herein.

In the embodiment shown in FIGS. 5A and 5B, the retaining bulged point 78 of the rotor 5 is rotated on the retaining section 101 of the first member 10 by sliding on the first member 10. In terms of manufacturing, the rotor 5 generally is made of metal, and the first member 10 generally is made of plastics. In terms of wearing durability, the metal bulged point 78 has a longer durability than the plastic first member 10. It is noted that a plastic surface is easy to wear or become rough while being frequently rubbed, and thus may result in un-smooth pivotal rotation. Hence, friction between the rotor 5 and the first member 10 of the invention provided by a metal-to-metal sliding is preferably. Therefore, in another embodiment of the invention, the side of the retaining section 101 of the first member 10 that faces the rotor 5 is preferably made of metal.

In the embodiments of the invention, contact between the first latch element 71 and the second latch element 72 is preferably to apply matching slant surfaces. As shown in FIGS. 5A and 5B, the first latch element 71 and the second latch element 72 have respectively inclined angles. The inclined angle herein serves two functions. One is to enable the latch structure 70 to anchor the hinge apparatus in an unstable state more easily when the first member 10 and the second member 20 are stacked by an external force and to achieve the self-locking effect. Another purpose is that, upon when a user disengages the stacking state of the first member 10 and the second member 20 but absent-minded without depressing the compression member 30, the situation of the improper external folding force greater than a preset critical value can relieve forcedly the anchoring state of the latch structure 70 and also enable the first member 10 to separate from the second member 20 without damaging the entire latch structure 70 and the construction of the second member 20. Thereby, it is clear that the consideration of inclined angles of the invention gives the hinge apparatus better protection.

Figure 7:
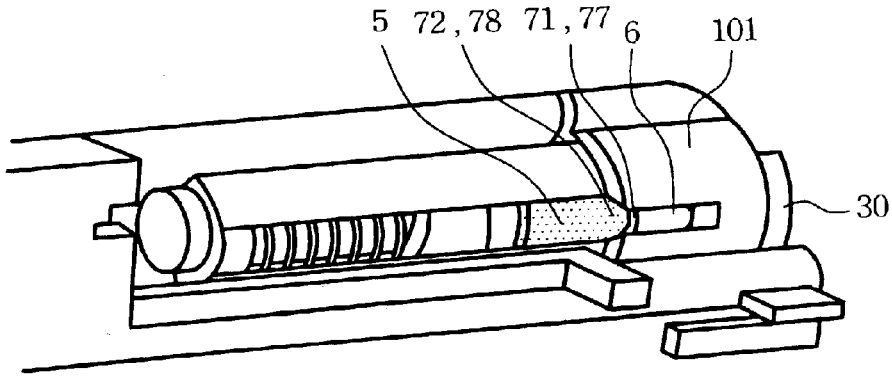
FIG. 7 is a schematic view of another embodiment of a latch structure of the invention.

Refer to FIG. 7 for another embodiment of the folding apparatus of the invention. The shaft retainer 6 is altered to become an element to contact the rotor 5 for the entire contact displacement (i.e. the shaft retainer 6 becomes a separated end of the retaining section 101 of the first member 10), and the retaining trough 77 (the first latch element 71) is located on the shaft retainer 6. Thereby, the rotor 5 may rotate on the metallic shaft retainer 6 without incurring wearing problems mentioned above.

The construction shown in FIG. 7 has made the shaft retainer 6 an extension of one side of the retaining section 101 to contact the rotor 5 (or called a second retaining ring). The first latch element 71 of the latch structure may be located on one side of the second retaining ring 6 facing the rotor 5. When the "compression member 30 is depressed" as previously discussed, it generates equivalent effect of "moving the rotor 5 (with the second retaining ring 6 stationary) to separate the retaining bulge point 78 from the retaining trough 77".

Comparing the embodiments shown in FIG. 5A and FIG. 7, it is indicated that the shaft retainer 6 may be seen as an element of the hinge apparatus (shown in FIG. 5A), or may become a separate element of the retaining section 101 (the second retaining ring as shown in FIG. 7).

In the invention, the latch structure generates an unstable anchoring relationship that generally is a stacking condition between the first member and the second member. However, in other embodiments, it may also be an angular relationship with each other.

Figure 8:
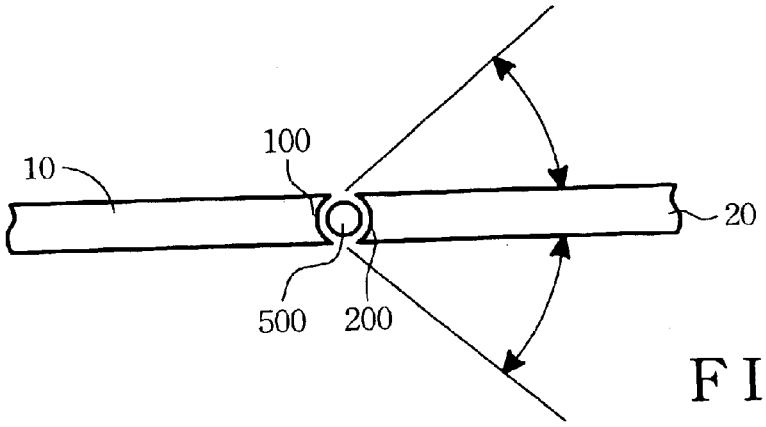
FIG. 8 is a schematic view of another embodiment of a folding apparatus of the invention.

In the invention, when the latch structure is removed from the folding apparatus discussed above, it becomes a single stable state apparatus. FIG. 8 shows yet another application embodiment of the invention. The hinge apparatus 500 is located between a first installation side 100 of a first member 10 and a second installation side 200 of a second member 20. When the first member 10 and the second member 20 incur a folding movement relative to each other, the second member 20 will be stabilized at a stable state relative to the first member 10 (the object location, as shown in the drawing) through the hinge apparatus 500 of the invention. Such an embodiment is commonly employed on doors. When people or goods is passing a door 20 (second member), the door 20 is turned through the auto cam sliding pair to an unstable state and potential energy is stored in the compression spring of the hinge apparatus. When people or goods have passed the door 20, the elastic potential energy generated by the compression spring and the auto cam sliding pair is released, and thus the door 20 may automatically return to its stable state in a damped oscillation manner. The damped oscillation is incurred due to friction loss taking place among the elements.

The invention provides a self-locking single stable state hinge apparatus that forms a pivotal rotation mode through a cam sliding contact between two objects, and employs a compression spring to replace the conventional torsion spring. A single stable state apparatus is formed and may be controlled by a depressing force. It provides a versatile design for pivotal rotation mechanisms and folding apparatus.

While the present invention has been particularly shown and described with reference to a preferred embodiment, it will be understood by those skilled in the art that various changes in form and detail may be without departing from the spirit and scope of the present invention.

I claim:

1. A self-locking hinge apparatus with a single stable state for providing a hinge rotational movement and automatic stabilizing at the single stable state, comprising:

a pivotal shaft, further having a retaining end and a free end;

a retaining ring, slidably and pivotally mounted on the pivotal shaft at the retaining end;

a stator mounted on the pivotal shaft in a slide-able but not rotatable manner;

a compression spring mounting on the pivotal shaft between the retaining ring and the stator; and a rotor, slidably and pivotally mounted on the pivotal shaft adjacent to the free end and pressing the stator;

wherein the rotor has a sliding surface facing the stator that forms a strictly concave surface surrounding the pivotal shaft, the sliding surface having a lowest point, the stator having a bulged point extending to and pressing upon the sliding surface such that when the stator and the rotor are initiated at a position, the compression spring pushes the bulged point of the stator in the axial direction of the pivotal shaft on the sliding surface of the rotor to make the sliding surface automatically sliding on the bulged point and to drive the rotor rotating about the pivotal shaft and to stop the sliding and the rotating until the bulged point reaches the lowest point of the sliding surface.

2. The self-locking hinge apparatus with a single stable state of claim 1, wherein the bulged point of the stator is the most protrusive point of a convex surface.

3. The self-locking hinge apparatus with a single stable state of claim 1, wherein the pivotal shaft has at least one chamfered cross section corresponding to where the stator is located, the stator having a shaft opening with a complementary cross section corresponding to the chamfered cross section to enable the stator to perform sliding but not rotating movements on the pivotal shaft.

4. The self-locking hinge apparatus with a single stable state of claim 1, wherein the pivotal shaft has at least one axial key way formed on a location corresponding to where the stator is located, and the stator has a shaft opening which has a jutting key corresponding to and coupling with the key way thereby to enable the stator to perform sliding but not rotating movements on the pivotal shaft.

5. A self-locking hinge apparatus with a single stable state for providing a hinge rotational movement and automatic stabilizing at the single stable state, comprising:

a pivotal shaft, having a retaining end and a free end;

a retaining ring, pivotally and slidably mounted on the pivotal shaft at the retaining end;

a stator, mounting on the pivotal shaft in a slide-able but not rotatable manner;

a compression spring, mounting on the pivotal shaft between the retaining ring and the stator; and a rotor, slidably and pivotally mounted on the pivotal shaft adjacent to the free end and pressing the stator;

wherein the stator has a stator surface facing the rotor that is formed a strictly concave surface surrounding the pivotal shaft, the stator surface having a lowest point, the rotor having a bulged point extending to and pressing upon the stator surface such that when the stator and the rotor are initiated at a position, the compression spring pushes the bulged point of the rotor in the axial direction of the pivotal shaft to enable the bulged point to automatically slide on the stator surface and to drive the rotor rotating about the pivotal shaft and to stop the sliding and rotating until the bulged point reaches the lowest point of the stator surface.

6. The self-locking hinge apparatus with a single stable state of claim 5, wherein the bulged point of the rotor is the most protrusive point of a convex surface.

7. The self-locking hinge apparatus with a single stable state of claim 5, wherein the pivotal shaft has at least one chamfered cross section corresponding to where the stator is located, the stator having a shaft opening with a complementary cross section corresponding to the chamfered cross section to enable the stator to perform sliding but not rotating movements on the pivotal shaft.

8. The self-locking hinge apparatus with a single stable state of claim 5, wherein the pivotal shaft has at least one axial key way formed on a location corresponding to where the stator is located, and the stator has a shaft opening which has a jutting key corresponding to and coupling with the key way thereby to enable the stator to perform sliding but not rotating movements on the pivotal shaft.

9. A folding apparatus, comprising:

a first member, having a first installation side;

a second member, having a second installation side corresponding to the first installation side; and at least one self-locking hinge apparatus with a single stable state, located on the first installation side and the second installation side to allow the first member stacking over the second member, wherein the hinge apparatus provides a single stable state and comprises:

a pivotal shaft, having a retaining end and a free end;

a retaining ring, fixedly located on the first installation side of the first member proximate to the retaining end of the pivotal shaft having an inner shaft opening to allow the pivotal shaft to slide therein;

a stator, mounting on the pivotal shaft in a slide-able but not rotatable manner and having a stator surface facing the free end of the pivotal shaft;

a compression spring, mounting on the pivotal shaft between the retaining ring and the stator; and a rotor, fixedly located on the second installation side of the second member proximate to the free end of the pivotal shaft having a shaft opening to allow the pivotal shaft to slide and rotate therein, and having a sliding surface facing the stator and pressing the stator surface to form an auto cam sliding pair;

wherein the auto cam sliding pair has a sliding stop point; when the stator surface of the stator and the sliding surface of the rotor are coupled and contacted the compression spring pushes the stator towards the rotor to make the sliding surface automatically slide on the stator surface until reaching the sliding stop point.

10. The folding apparatus of claim 9, wherein the stator surface is a strictly concave surface surrounding the pivotal shaft and has a lowest point, the rotor having a bulged point extending to and pressing the stator surface.

11. The folding apparatus of claim 9, wherein the sliding surface is a strictly concave surface surrounding the pivotal shaft and has a lowest point, the stator having a bulged point extending to and pressing on the sliding surface.

12. The folding apparatus of claim 9, wherein the pivotal shaft has at least one chamfered cross section corresponding to where the stator is located, the stator having a shaft opening with a complementary cross section corresponding to the chamfered cross section to enable the stator to perform sliding but not rotating movements on the pivotal shaft.

13. The folding apparatus of claim 9, wherein the pivotal shaft has at least one axial key way formed on a location corresponding to where the stator is located, the stator having a shaft opening which has a jutting key corresponding to and coupling with the key way thereby to enable the stator to perform sliding but not rotating movements on the pivotal shaft.

14. The folding apparatus of claim 9 further having a latch structure which includes a first latch element and a second latch element, the first latch element and the second latch element being engageable to allow the first member to stack on one side of the second member.

15. The folding apparatus of claim 14, wherein the first latch element is located on the first member and the second latch element is located on the second member at a location corresponding to the first latch element, the first latch element and the second latch element being not connected to the hinge apparatus.

16. The folding apparatus of claim 14, wherein the first member further includes a retaining section extending to the free end to form an outer retention of the rotor, the second latch element of the latch structure being a retaining bulged point located on the rotor facing the free end, the first latch element being a retaining trough located on the retaining section corresponding to the retaining bulged point, the latch structure further including a compression member located on the retaining section; wherein when the retaining bulged point and the retaining trough form a latched retention, the first member being stacked on the second member; when the compression member subjects to an external force for releasing the latched retention between the retaining bulged point and the retaining trough, the rotor automatically slides to the sliding stop point due to the function of the auto cam sliding pair.

17. The folding apparatus of claim 16, wherein the retaining section further has a second retaining ring located on the retaining section to contact the rotor, the retaining trough being located on one side of the second retaining ring facing the rotor, the compression member subjects to an external force being equivalent to moving the rotor to separate the retaining bulged point away from the retaining trough.

18. The folding apparatus of claim 17, wherein the second retaining ring is made of metal.

19. The folding apparatus of claim 16, wherein the first latch element and the second latch element form a slant surface contact.

* * * * *